United States Patent [19]

Yamauchi et al.

[11] Patent Number: 4,945,339

[45] Date of Patent: Jul. 31, 1990

[54] ANTI-THEFT SENSOR MARKER

[75] Inventors: Kiyotaka Yamauchi; Yoshihito Yoshizawa, both of Saitama, Japan

[73] Assignee: Hitachi Metals, Ltd., Tokyo, Japan

[21] Appl. No.: 271,791

[22] Filed: Nov. 16, 1988

[30] Foreign Application Priority Data

Nov. 17, 1987 [JP] Japan ..... 62-290366

[51] Int. Cl.[5] ..... G08B 13/24

[52] U.S. Cl. ..... 340/551; 340/572

[58] Field of Search ..... 340/551, 572; 148/306, 148/307, 308, 309, 310

[56] References Cited

U.S. PATENT DOCUMENTS

| | | | |
|---|---|---|---|
| 4,298,862 | 11/1981 | Gregor et al. | 340/572 |
| 4,484,184 | 11/1984 | Gregor et al. | 340/551 |
| 4,495,487 | 1/1985 | Kanesh | 340/551 |
| 4,510,489 | 4/1985 | Anderson, III et al. | 340/572 |
| 4,510,490 | 4/1985 | Anderson, III et al. | 340/572 |
| 4,539,558 | 9/1985 | Fearon | 340/551 |
| 4,553,136 | 11/1985 | Anderson, III et al. | 340/572 |
| 4,647,917 | 3/1987 | Anderson, III et al. | 340/551 |
| 4,779,076 | 10/1988 | Weaver | 340/551 |
| 4,823,113 | 4/1989 | Hasegawa | 340/551 |

*Primary Examiner*—Joseph A. Orsino
*Assistant Examiner*—Geoff Sutcliffe
*Attorney, Agent, or Firm*—Sughrue, Mion, Zinn, Macpeak & Seas

[57] ABSTRACT

An anti-theft sensor marker is disclosed which has good sensitivity characteristics and which does not readily deteriorate due to bending stress. The marker is mainly composed of an alloy ribbon and is employed in an anti-theft system in which the stealing of a commodity previously marked by the marker is determined by detecting a magnetic field of a specific frequency with respect to an incident magnetic field intensity applied to a detection region through the alloy ribbon of the marker when the marker is disposed within the detection region. The alloy ribbon has the constitutional formula $$(Fe_{1-a}M_a)_{100-x-y-z-\alpha-\beta-\gamma}\,Cu_xSi_yB_zM'_\alpha M''_\beta X_\gamma$$
(atomic %)

wherein, M is at least one member selected from the group consisting of Co and Ni; M′ is at least one member selected from the group consisting of Nb, W, Ta, Zr, Hf, Ti and Mo; M″ is at least one member selected from the group consisting of V, Cr, Mn, Al, platinum metals, Sc, Y, rare-earth metals, Au, Zn, Sn and Re; X is at least one member selected from the group consisting of C, Ge, P, Ga, Sb, In, Be and As; and a, x, y, z, $\alpha$, $\beta$ and $\gamma$ satisfy the relations: $0 \leqq a \leqq 0.3$, $0.1 \leqq x \leqq 3$, $6 \leqq y \leqq 25$, $3 \leqq z \leqq 15$, $14 \leqq y+z \leqq 30$, $1 \leqq \alpha \leqq 10$, $0 \leqq \beta \leqq 10$, $9 \leqq \gamma \leqq 10$, and wherein at least 50% of the structure of the alloy ribbon is composed of fine bccFe solid-solution crystalline grains in which the mean grain diameter, measured as a maximum grain diameter, is not larger than 500 Å.

13 Claims, 3 Drawing Sheets

ANTI-THEFT SENSOR MARKER

FIELD OF THE INVENTION

The present invention relates to an anti-theft sensor marker for use in an anti-theft sensor system in which, for example, a commodity of a store which has not been paid for, or a book in a library which is not allowed to be checked out of the library, is identified by a marker previously attached to the commodity or the book.

BACKGROUND OF THE INVENTION

Heretofore, magnetism has been used in an anti-theft system to prevent, for example, the stealing of books from a library or commodities from a department store (Refer to Japanese Patent Post-Examination Publication No. 58-53800 and U.S. Pat. No. 4,510,489). In such a system, a marker having a width of 1–2 mm and being formed of an amorphous alloy thin ribbon is previously attached to every book or every commodity. In order to lawfully remove such a commodity or book, for example, the commodity or book is delivered to a customer outside of a marker detector after a lawful procedure (i.e.. paying for the commodity or signing out the book) is completed in a reception or adjustment office. On the other hand, a commodity or the like which is illegally or unlawfully taken out is detected through the marker previously attached to the commodity or the like by detecting the magnetic field of a frequency having a harmonic relationship to the magnetic field of a specific frequency applied to a detection region set up at an entrance or exit. In short, the stealing of the commodity is checked.

FIG. 1 is a typical circuit diagram showing an example of the aforementioned magnetic anti-theft system. In the drawing, the reference numeral 1 designates an oscillator for generating an AC current of a frequency f. The reference numeral 2 designates a notch filter formed to remove a specific frequency from the alternating current and arranged to transmit the AC current to an oscillation coil 4 through an amplifier 3. The reference numeral 5 designates a receiving coil. The receiving coil 5 and the oscillation coil 4 form a detection region 6. A lock-in amplifier 7 and a signal processing circuit 8 are connected in series to the receiving coil 5.

According to the aforementioned construction, a specific harmonic component can be outputted through the lock-in amplifier 7 when, for example, the marker 9 is disposed within the detection region 6 to which an incident magnetic field Ha is applied, in the presence of a bias magnetic field Hb (the geomagnetisim). The specific harmonic componet thus outputted can be converted into a visible or audible signal through the signal processing circuit 8. Accordingly, a wrongful act can be easily exposed or prevented by connecting a patrol light or buzzer to the succeeding stage of the signal processing circuit 8.

As another method, there is known an anti-theft system using a marker formed of an amorphous alloy thin robbon having a relatively large electromechanical coupling coefficient. According to this system, the marker is excited with an AC current after being biased magnetically, so that the stealing of the commodity or the like can be detected through the presence of the marker by measuring frequencies of resonance and non-resonance.

Similar methods other than the aforementioned methods are known as anti-theft sensor system using a marker formed of an amorphous alloy thin ribbon. The most important feature in these systems is that the soft magnetic alloy, used as the marker, has excellent magnetic characteristics. In other words, the requirement for the magnetic characteristics of the marker used in the anti-theft sensor system is as follows: (1) the magnetic permeability is large; (2) the magnetizing curve is angular and (3) the coercive force is relatively small.

FIG. 2 shows the dependence or relationship of the output voltage on or with the incident magnetic field in the case where the marker, formed of a soft magnetic alloy, is present within the detection region 6 in the system of FIG. 1. In the FIG. 2, a designates a tertiary harmonic component (3f) and b designates a secondary harmonic component (2f). In the system, the value 2f–3f is detected so that the presence of the maker within the detection region can be identified. Accordingly, the detection sensitivity of the marker increases as the area surrounded by the curve a and the x-coordinate axis increases relative to the area surrounded by the curve b and the x-coordinate axis.

FIG. 3 shows an example of the anti-theft sensor marker. In FIG. 3, the reference numeral 10 designates a soft magnetic alloy ribbon the reference numeral 11 designates a first support member, for example, formed of paper, and the reference numeral 12 designates a second support member, for example, formed of polypropylene. The soft magnetic alloy ribbon 10 is fixed between the support members 11 and 12 through an adhesive agent. In general, an adhesive agent is also applied to the rear surface of the member 11 so that the marker can be easily fixed to a commodity or the like.

The requirement for the characteristics of the soft magnetic alloy used in the marker is as follows: (1) maximum magnetic permeability is large; (2) the angular rate of the magnetizing curve is large; (3) the coercive force is relatively small; and (4) magnetostriction is small.

Permalloy and amorphous alloy are known as soft magnetic alloys having the aforementioned characteristics (for example, as disclosed in Japanese Patent Post-Examination Publication No. 58-53800, Japanese Patent Unexamined Publication No. 58-39396, and the like). Almost all of the magnetic anti-theft sensor markers which have been put into practice employ one of the aforementioned soft magnetic alloys.

As described above, the prior art type anti-theft sensor markers have employed either permalloy or amorphous alloy. However, in the case of permalloy, the soft magnetic characteristics deteriorate remarkably due to bending stress, and therefore the range of use is limited because the marker within the detection region cannot always be detected. On the other hand, in the case of amorphous alloy, the deterioration of the soft magnetic characteristics due to bending stress is considerably less than that in the case of permalloy. Accordingly, the use of amorphous alloy is superior to the use of permalloy in this respect. However. the soft magnetic characteristics of amorphous alloy as a marker is unsatisfactory. More particularly, in order to reduce the deterioration of the soft magnetic characteristics due to bending stress, amorphous alloy, in general, mainly contains Co and has a relatively small saturation magnetostriction constant($\lambda_s$).

As a result, the costs associated with the Co amorphous alloy are expensive.

SUMMARY OF THE INVENTION

Accordingly it is an object of the present invention to provide a novel anti-theft sensor marker which has excellent soft magnetic characteristics, which only undergoes a small amount of deterioration due to bending stress, and which employs an economical soft magnetic alloy ribbon to thereby solve the aforementioned problems in the prior art.

The present invention accomplishes these objects by providing an anti-theft sensor marker which is mainly composed of an alloy ribbon, and which is used in an anti-theft system in which the stealing of a commodity previously marked by the marker is detected on the basis of whether or not the marker is present by detecting a magnetic field of a specific frequency with respect to an incident magnetic field intensity applied to a detection region through the alloy ribbon of the marker disposed within the detection region, the alloy ribbon having the constitutional formula $$(Fe_{1-a}M_a)_{100-x-y-z-\alpha-\beta-\gamma}\,Cu_xSi_yB_zM'_\alpha M''_\beta X_\gamma \quad \text{(atomic \%)}$$

(in which M is at least one member selected from the group consisting of Co and Ni; M' is at least one member selected from the group consisting of Nb, W, Ta, Zr, Hf, Ti and Mo; M'' is at least one member selected from the group consisting of V, Cr, Mn, Al, platinum metals, Sc, Y, rare-earth metals, Au, Zn, Sn and Re; X is at least one member selected from the group consisting of C, Ge, P, Ga, Sb, In, Be and As; and a, x, y, z, $\alpha$, $\beta$ and $\gamma$ satisfy the relations: $0 \leqq a \leqq 0.3$, $0.1 \leqq x \leqq 3$, $6 \leqq y \leqq 25$, $3 \leqq z \leqq 15$, $14 \leqq y+z \leqq 30$, $1 \leqq \alpha \leqq 10$, $0 \leqq \beta 10$, $9 \leqq \gamma \leqq 10$), at least 50% of the structure of the alloy ribbon being composed of fine bccFe solid-solution crystalline grains in which the mean grain diameter, measured as a maximum grain diameter, is not more than 500 Å.

Because the alloy ribbon has good soft magnetic characteristics, a highly-sensitive anti-theft sensor marker can be obtained.

DETAILED DESCRIPTION OF THE INVENTION

Figure 1:
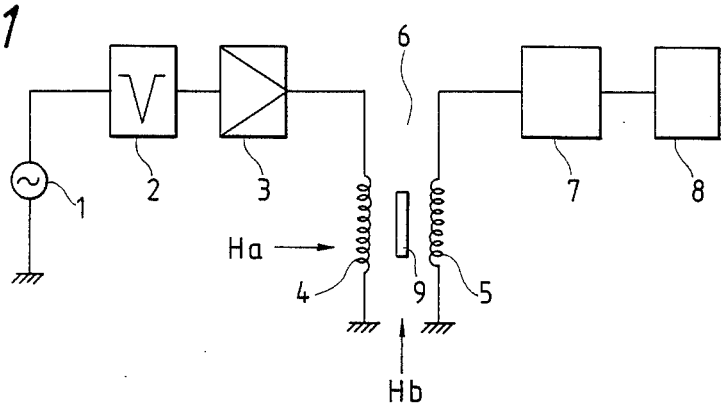
FIG. 1 circuit diagram showing an example of a magnetic anti-theft sensor system.

In the present invention, Cu is one of the essential elements and the Cu content x is within a range between 0.1 and 3 atomic %. If the Cu content x is less than 0.1 atomic %, the effect of improving maximum magnetic permeability due to the addition of Cu cannot be expected. If the Cu content is more than 3 atomic %, maximum magnetic permeability may become smaller than that in the case where Cu is not added. In particular, the preferred Cu content x is within a range between 0.5 and 2 atomic %. When the Cu content is within this range, maximum magnetic permeability becomes larger to obtain an anti-theft sensor marker having high detection sensitivity.

In general, the alloy employed in the present invention can be prepared by the process for removing an amorphous alloy of the aforementioned constitution from a molten bath by quenching or by a vapor-phase quenching method, such as a sputtering method, a vapor deposition method or the like, and the heat-treatment process for forming fine crystalline grains by heating.

The cause of the improvement of maximum magnetic permeability depending on the content of Cu is unclear, but may be explained as follows.

Because the parameter of interaction of Cu and Fe is positive and, accordingly, the solid solubility of Cu and Fe is so low that Cu and Fe have a tendency to become separated from each other, Fe atoms or Cu atoms are gathered with the heating of an amorphous-state alloy to thereby form a cluster to produce constitutional fluctuation. For this reason, a large number of partly crystalline regions are formed and accordingly, nucleated to produce fine crystalline grains. Because the crystals mainly contain Fe and because the solid solubility of Fe and Cu is small, Cu atoms are swept out of the fine crystalline grains with the advance of crystallization, so that the Cu concentration in the peripheral regions of the crystalline grains increases. It is possible to consider that the crystalline grains are difficult to grow for this reason.

The formation of fine crystalline grains may be caused by the fact that a large number of crystalline nuclei are produced with the addition of Cu and the fact that the crystalline grains are difficult to grow. It is believed that this function is remarkably increased in the presence of specific elements, such as Nb, Ta, W, Mo, Zr, Hf, Ti and the like.

Without the specific elements, such as Nb, Ta, W, Mo, Zr, Hf, Ti and the like, fine crystalline grains are not sufficiently produced, so that the soft magnetic characteristics become poor.

Further, in the case of the alloy according to the present invention, a fine crystalline layer mainly containing Fe is formed, so that the magnetostriction of the alloy is smaller than that of Fe amorphous alloy. As the magnetostriction decreases, magnetic anisotropy due to internal bending stress decreases. This is considered to be one of the reasons why the soft magnetic characteristics are improved.

Without the addition of Cu, the crystalline grains hardly become fine. In this case, a compound layer is easily produced, so that the magnetic characteristics deteriorate due to crystallization.

Si and B are elements useful for the formation of fine grains and the adjustment of magnetostriction in the alloy. It is preferable that the alloy according to the invention is prepared by forming fine crystalline grains through heat treatment after adding Si and B to form amorphous alloy. The reason for the limitation of the Si content y is as follows. If y is more than 25 atomic %, the magnetostriction undesirably increases under the good condition of soft magnetic characteristics. If y is less than 6 atomic %, sufficient maximum magnetic permeability cannot be attained. The reason for the limitation of the B content z is as follows. If z is less than 3 atomic %, a uniform crystalline grain structure cannot be attained, so that the maximum magnetic permeability undesirably decreases. If z is more than 15 atomic %, magnetostriction undesirably increases under the heat treatment condition suitable for good soft magnetic characteristics. The reason for the limitation of the sum amount y+z of Si and B is as follows. If y+z is less than 14 atomic %, noncrystallization is difficult, so that soft magnetic characteristics deteriorate. If y+z is more than 30 atomic %, there occur a remarkable decrease of saturation flux density, a decrease of maximum magnetic permeability and an increase of magnetostriction. It is preferable that the Si content and the B content satisfy the relations: $10 \leqq y \leqq 25$, $3 \leqq z \leqq 12$ and $18 \leqq y+z \leqq 28$. When the Si content and the B content satisfy the aforementioned relations, a low-loss alloy having saturation magnetostriction of $5 \times 10^{-6}$ or less can be easily prepared, so that the deterioration of the characteristics of the anti-theft sensor marker due to bending stress can be reduced.

It is preferable that the Si content and the B content satisfy the relations: $11 \leqq y24$, $3 \leqq z \leqq 9$ and $18 \leqq y+z \leqq 27$. When the Si content and the B content satisfy the aforementioned relations, an alloy having a saturation magnetostriction between $-1.5 \times 10^{-6}$ and $1.5 \times 10^{-6}$ and having improved deterioration of soft magnetic characteristics due to bending stress can be easily prepared.

In the alloy according to the present invention, M' has the function of making the precipitated crystalline grains fine by the combination addition of M' and Cu. M' is at least one member selected from the group consisting of Nb, W, Ta, Zr, Hf, Ti and Mo. These elements, such as Nb and the like, have the function of rising the crystallization temperature of the alloy. On the other hand, Cu has the function of lowering the crystallization temperature through the formation of a cluster. It is possible to consider that the growing of the crystalline grains are suppressed by the interaction of these elements and Cu to make the precipitated crystalline grains fine. It is preferable that the M' content $\alpha$ is within a range: $1 \leqq \alpha \leqq 10$. If $\alpha$ is less than 1 atomic %, maximum magnetic permeability decreases. If $\alpha$ is more than 10 atomic %. saturation flux density decreases remarkably. Accordingly, the preferred range of $\alpha$ is $2 \leqq \alpha \leqq 8$. When $\alpha$ is within the aforementioned range, low-loss characteristics suited to the anti-theft sensor marker can be obtained.

The addition of M" effectuates the improvement of durability against corrosion, the improvement of magnetic characteristics, the adjustment of magnetostriction, and the like.

If M" is more than 10 atomic %, saturation flux density is remarkably lowered.

In the magnet core according to the present invention, an alloy containing 10 atomic % or less of at least one element selected from the group of C, Ge, P, Ga, Sb, In, Be, As and the like can be used. These elements are useful elements for non-crystallization. The addition of these elements together with Si and B effectuates the acceleration of non-crystallization of the alloy, and the adjustment of magnetostriction and Curie temperature.

Although the residual part mainly contains Fe except for impurities. Fe may be partly replaced by the component M (Co and/or Ni). The M content is $0 \leqq a \leqq 0.3$. If the M content is more than 0.3, magnetostriction increases or maximum magnetic permeability decreases.

Although the alloy according to the invention is an alloy mainly composed of a bcc-structure iron solid solution, the alloy may include amorphous layers, compound layers of transition metals, such as $Fe_2B$, $Fe_3B$, Nb, and the like, $Fe_3Si$ regular layers and the like. These layers often deteriorate the magnetic characteristics. In particular, the compound layers of $Fe_2B$ or the like are apt to deteriorate the soft magnetic characteristics. Accordingly, it is preferable that these layers be absent as much as possible.

The alloy according to the present invention is composed of hyperfine crystalline grains having the grain size of 500 Å or less and which are uniformly distributed. In most cases, the alloy is particularly excellent in soft magnetic characteristics and has the mean grain diameter within a range between 20 and 200 Å.

It is possible to consider that the crystalline grains are composed of an $\alpha$-Fe solid solution in which Si, B and the like are dissolved in the form of a solid. The alloy structure, except the fine crystalline grains, is mainly amorphous. If the ratio of the fine crystalline grains reaches 100%, the magnetic core according to the present invention shows sufficiently high maximum magnetic permeability.

It is a matter of course that the alloy may contain unavoidable impurities, such as N, O, S and the like, Ca, Sr, Ba, Mg and the like as long as the necessary characteristics thereof are not too deteriorated, and that the constitution of the alloy modified as described above can be identified as the constitution of the alloy used in the anti-theft sensor marker according to the present invention.

The alloy used in the magnetic core according to the present invention can be prepared by any one of various methods, such as those of forming fine crystalline grains through heat treatment after forming an amorphous thin ribbon by a single-roll method, a double-roll method, a centrifugal quenching method or the like; those of crystallizing amorphous film through heat treatment after forming the amorphous film by a vapor deposition method, a sputtering method, an ion-plating method or the like; those of crystallizing amorphous line through heat treatment after forming the amorphous line by a rotary liquid spinning method or a glass-coat spinning method; and the like. Accordingly the alloy according to the invention can appear in various forms, such as a line, a thin ribbon, a film and the like. In general, the form of a thin ribbon is most suitable for the anti-theft sensor marker.

The heat treatment carried-out for obtaining the magnetic core according to the invention has the double purpose of decreasing internal bending stress and forming a fine crystalline grain structure to improve maximum magnetic permeability and to decrease magnetostriction.

In general, the heat treatment is ordinarily carried out in vacuum or inert gas, such as hydrogen gas, nitrogen gas, argon gas and the like. As occasion demands, the heat treatment may be carried out in an oxidizing atmosphere, such as in the air.

The temperature and time required for the heat treatment vary according to the form, size and constitution of the amorphous alloy ribbon. In general, it is preferable that the temperature and time are within a temperature range between 450° C. and 700° C. higher than the crystallization temperature and within a time range between 5 minutes and 24 hours.

The conditions of heating and cooling in the heat treatment can be suitably changed if necessary. The heat treatment may be separated into a plurality of stages to be carried out at the same temperature or at different temperatures or may be carried out in multi-stage heat-treatment patterns. Further, the heat treatment of the alloy may be carried out in a magnetic field generated by a direct current or an alternating current. By carrying out the heat treatment in the magnetic field, magnetic anisotropy can be established on the alloy. By carrying out the heat treatment while applying the magnetic field in parallel to the axis of the alloy ribbon, the B-H curve can be shaped angularly. In the case where the angular ratio is not smaller than 60%, and the maximum magnetic permeability is not smaller than 50,000, a highly-sensitive anti-theft sensor marker can be prepared.

It is unnecessary to apply the magnetic field at all times during the heat treatment. The period for the application of the magnetic field can be suitably selected as long as the temperature in the period is lower than the Curie temperature Tc of the alloy. With the progress of the heat treatment, the Curie temperature of the main phase of the alloy formed by the heat treatment gradually increases from the temperature of the initial amorphous alloy. Accordingly, the heat treatment can be carried out in the magnetic field at a higher temperature than the Curie temperature of the initial amorphous alloy. By passing an electric current through the magnetic core or by applying a high-frequency magnetic field to the magnetic core during the heat treatment, the magnetic core can be heat-treated. In the case where the heat treatment is carried out in the magnetic field, the heat treatment may be separated into a plurality of stages. By carrying-out the heat treatment while applying tension or compressing force, the magnetic characteristics may be adjusted more suitably.

The following method shows an example of an industrial method for producing an anti-theft sensor marker of a soft magnetic alloy according to the present invention.

Figure 4:
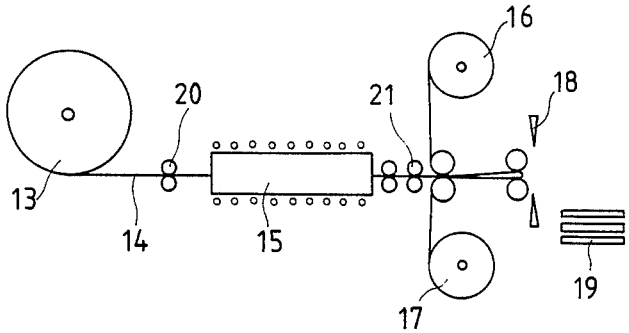
FIG. 4 is a schematic view of a method for producing the marker.

In the method for producing an anti-theft sensor marker, the amorphous alloy thin ribbon having the constitution of the invention and, for example, prepared by a single-roll method is taken up on a reel and then successively passed through the continuous heat-treatment step, laminating step, and cutting step by the method as shown in FIG. 4 to thereby produce an anti-theft sensor marker. In FIG. 4, the reference numeral 13 designates a reel, the reference numeral 14 designates an amorphous alloy ribbon, the reference numeral 15 designates a heat-treatment furnace, the reference numeral 16 designates a reel, for example, for supplying polypropylene, the reference numeral 17 designates a reel, for example, for supplying paper, the reference numeral 18 designates cutting means, the reference numeral 19 designates anti-theft sensor marker articles, the reference numeral 20 designates ribbon feed rollers, and the reference numeral 21 designates adhesive-agent applying rollers.

Although the aforementioned producing method is an example of a method for producing the anti-theft sensor marker according to the present invention; this method must be strictly managed so that the delicate heat-treated ribbon is not injured before the ribbon is produced as an article. If protective materials or constituent members, such as paper, propylene and the like, of the maker are weak in strength, the maker produced as an article by the aforementioned method may be injured.

In order to solve these problems it is desirable that a coating layer, which is durable against the heat-treatment temperature, is applied to the surface of the alloy ribbon, for example by metal plating or the like. By the application of the coating layer, considerable "staying power" is brought to the ribbon even though the ribbon has been heat-treated. Accordingly, injuries during or after the production of the anti-theft sensor marker can be remarkably reduced, thereby providing good results of the invention. For example, non-magnetic plating of Cu or the like is suitable for the metal plating. As occasion demands, magnetic plating of Ni or the like may be employed or plating of magnetic alloy having semi-hard magnetic characteristics may be employed.

The anti-theft sensor marker according to the present invention can be widely used for various purposes insofar as the marker is mainly composed of a soft magnetic alloy suitably selected. Further, it is a matter of course that the same effect can be attained even in the case where the anti-theft sensor marker is combined with a semi-hard magnet for the purpose of repeated use.

The present invention will be described in more detail with reference to the following examples, however, the invention is not limited thereto.

EXAMPLE 1

Figure 5:
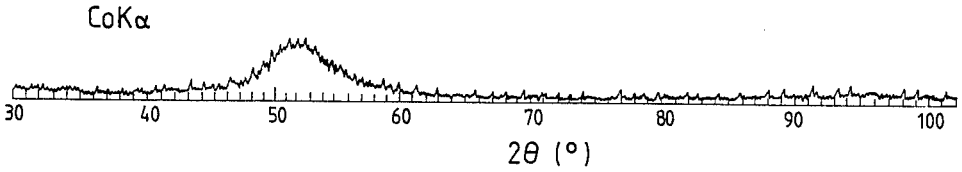
FIG. 5 is a view showing the X-ray pattern of an amorphous alloy.

A ribbon with the width of 2 mm and the thickness of 15 μm was prepared by a single-roll method using a fusion containing 1% of Cu. 13.5% of Si, 9% of B, 3% of Nb and a residual part of Fe in atomic ratio. The X-ray diffraction of the ribbon was measured, and a halo pattern typical in amorphous alloy as shown in FIG. 5 was obtained. It was apparent from the results that the ribbon was almost perfectly amorphous.

The amorphous ribbon was cut into the length of 7 cm and then heat-treated in a magnetic field in an atmosphere of $N_2$ gas. During the heat treatment, the magnetic field of 800 A/m was applied in parallel to the axis of the ribbon. The heating speed was 10° C./min. After the heating at 550° C. for an hour, the ribbon was cooled to room temperature at the mean cooling speed of 2.5° C./min.

Figure 6A:
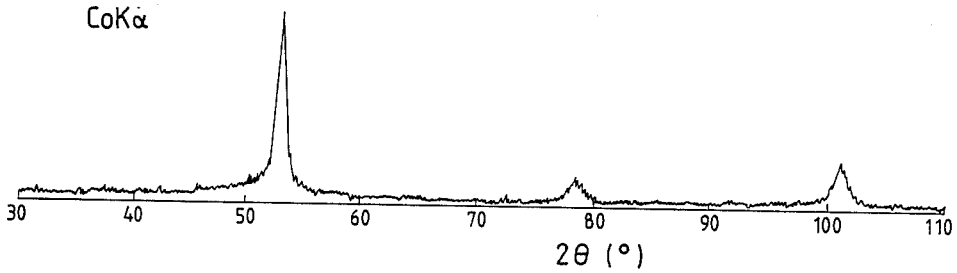
FIGS. 6(*a*) and, 6(*b*) are views showing the X-ray pattern and microscopic grain structure of an alloy according to the present invention, respectively.
Figure 6B:
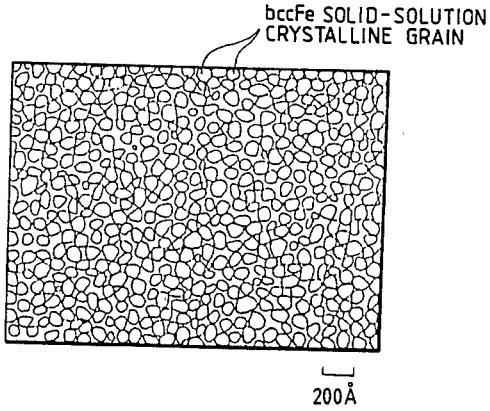

After the heat treatment, the X-ray diffraction pattern of the ribbon was as shown in FIG. 6(*a*) in which a crystalline peak appeared. The ribbon was observed with a transmission electron microscope as shown in FIG. 6(*b*). It was apparent from FIG. 6(*b*) that a large part of the structure of the ribbon was composed of hyperfine bccFe solid-solution crystalline grains distributed uniformly and having the grain size of from 50 to 200 Å.

Figure 2:
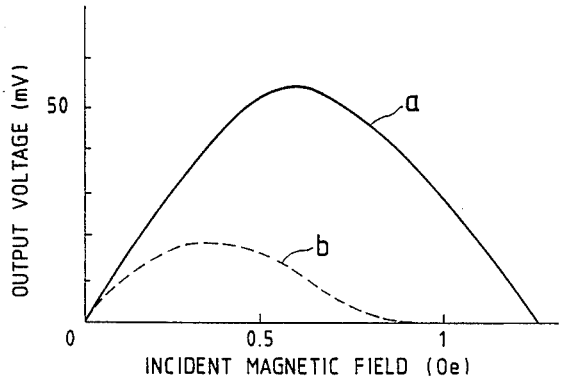
FIG. 2 is an explanatory view of a method for measuring sensitivity.
Figure 7:
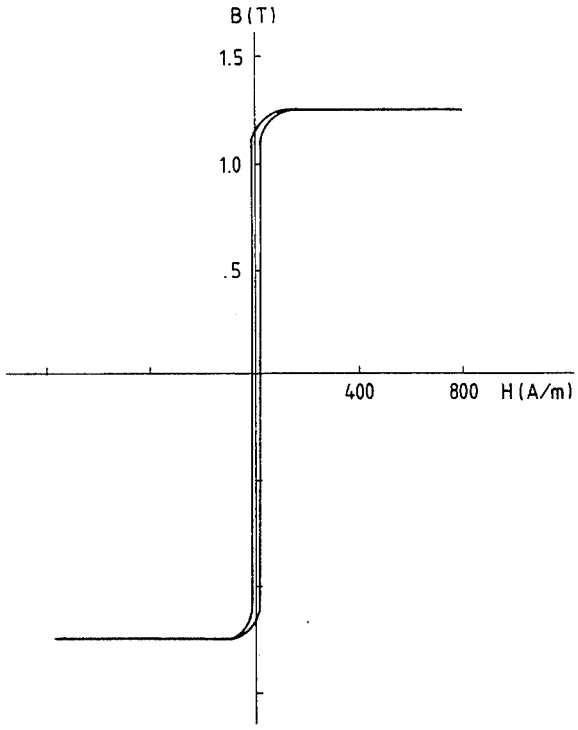
FIG. 7 is a graph view showing a B-H curve.

The B-H curve of the ribbon thus prepared was shown in FIG. 7. The magnetic characteristics of the ribbon were as follows. The coercive force Hc was 0.45 A/m, the maximum magnetic permeability μm was 160,000, the saturation flux density Bs was 1.24 T. and the angular ratio was 92%. The ribbon was put into the detection region 6 in the apparatus shown in FIG. 1 to examine incident magnetic field dependence. Secondary and tertiary harmonic components with respect to the frequency of the incident magnetic field were detected as shown in FIG. 2. From the curves as shown in FIG. 2, the ratio of the areas surrounded by the curves and the x-coordinate axis was calculated to judge whether the sensitivity of the ribbon was good. For comparison with the conventional samples, the sensitivity of amorphous ($Co_{70.5}Fe_{0.5}Mn_{6.5}Si_{13.5}B_9$) and supermalloy of the same form was measured in the manner as described above. The ratio of the sensitivity of the respective sample to the sensitivity of amorphous was shown in Table 1. It is apparent from Table 1 that the sensitivity of the sample according to the present invention was very good compared with the sensitivity of conventional samples.

EXAMPLE 2

A 2 mm wide and 20 μm thick amorphous alloy ribbon containing 1% of Cu, 16.5% of Si, 6% of B and 3% of Nb in atomic ratio was prepared by a single-roll method. An approximately 5 μm thick Cu layer was applied to the surface of the ribbon by electroless plating. After plating, the ribbon was cut into the length of about 7 cm and then heat-treated in a magnetic field. During the heat treatment, the magnetic field of 800 A/m was applied in parallel to the axis of the ribbon. After the heating at 530° C. for an hour, the ribbon was cooled to 280° C. at the cooling speed of 5° C./min. After the ribbon was left at 280° C. for two hours, the ribbon was further cooled to room temperature at the cooling speed of 2° C./min. The structure thus prepared was the same as shown in FIG. 6. The magnetic characteristics of the ribbon were as follows. The saturation flux density Bs was 1.20 T, the coercive force Hc was 0.96 A/m, the maximum magnetic permeability $\mu_m$ was 100,000, and the angular ratio was 87%.

Figure 8:
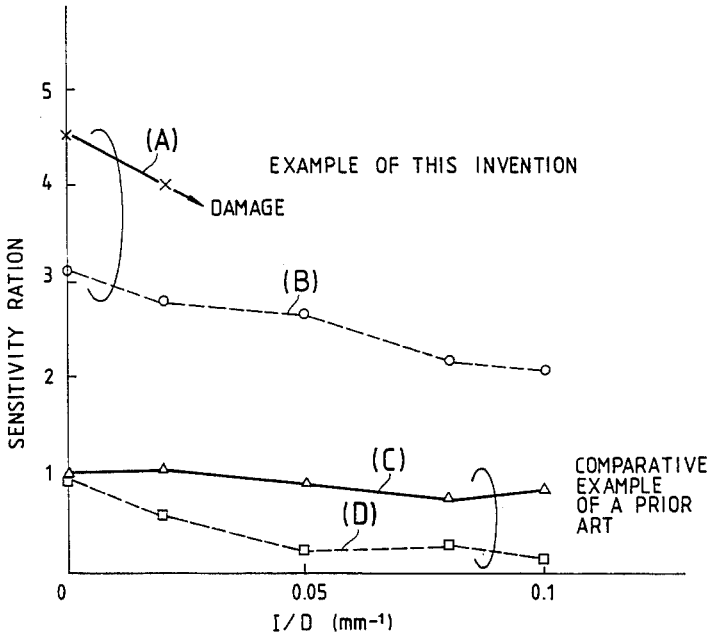
FIG. 8 is a graph showing the condition that the sensitivity ratio is deteriorated due to bending stress.

The sample according to the present invention was compared with the conventional samples in the same manner as in Example 1. Further, in order to examine the deterioration of sensitivity due to bending stress, the ribbon was wound on a round bar of diameter D (mm). Then the ribbon was returned to the original linear state to examine the change of sensitivity. The results were shown in FIG. 8. It is apparent from FIG. 8 that the sensitivity of amorphous (c) as a conventional sample defined in Example 1 was not satisfactory but the change of the sensitivity due to bending stress was little. The sensitivity of supermalloy (d) was not satisfactory and the deterioration of the sensitivity due to bending stress was considerable.

Figure 3:
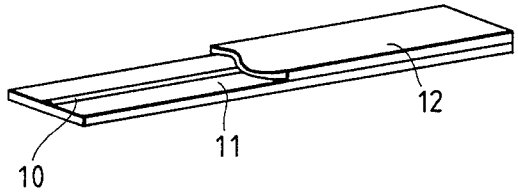
FIG. 3 is a perspective view of the structure of a marker.

On the contrary, the sensitivity of the sample of Example 1 according to the present invention was very high. However, the sample of Example 1 was injured when it was wound on the 20 mm diameter round bar. It is possible to consider that the probability of injury decreases because the anti-theft sensor marker is, in practice, used in the form as shown in FIG. 3. However, it is difficult to use the sample of Example 1 when severe bending stress acts on the sample. On the other hand, the sensitivity of the sample (b) of Example 2 according to the present invention was good and, at the same time, the deterioration of the sensitivity thereof due to bending stress was little. Thus, it is apparent that the sample (b) can be used as a very good anti-theft sensor marker.

EXAMPLE 3

A plurality of 1.2 mm wide and 18 μm thick amorphous alloy thin ribbons respectively constructed as shown in Table 2 were prepared by a single-roll method. After the respective ribbon was cut into the length of 7 cm, one sample (H in Table 2) was prepared by heat-treating the ribbon while applying a magnetic field of 800 A/m in parallel to the axis of the ribbon. Another sample (HF in Table 2) was prepared by heat-treating the ribbon without applying any magnetic field. The saturation flux density Bs, the angular ratio Br/Bs, the maximum magnetic permeability $\mu_m$ the saturation magnetostriction constant λs, and the sensitivity ratio measured on the two kinds of samples were as shown in Table 2.

The structures thus prepared were the same as shown in FIG. 6(*b*). It is apparent from Table 2 that the sensitivity of the respective sample of Example 3 according to the present invention is good compared with the conventional samples. In particular, in the case where the sample has the angular ratio of 60% or more and the maximum magnetic permeability of 60% or more, an anti-theft sensor marker having highest sensitivity can be prepared.

EXAMPLE 4

A plurality of 1.2 mm wide and 18 μm thick amorphous alloy thin ribbons respectively constructed as shown in Table 3 were prepared by a single-roll method. Samples were prepared in the same manner as in Example 3. During the heat treatment, a magnetic field was applied to the respective ribbon. The structures thus prepared were the same as shown in FIG. 6(*b*).

The typical magnetic characteristics, the saturation magnetostriction $\lambda_s$, the sensitivity ratio, and the sensitivity ratio measured in the case where the ribbon is returned to the original linear state after being wound on a 50 mm diameter round bar were as shown in Table 3. It is apparent from Table 3 that the all samples according to the present invention have good sensitivity and, in particular, in the case where $\lambda_s$ is not more than $+5\times10^{-6}$, the deterioration of the sensitivity ratio is remarkably little.

EXAMPLE 5

A plurality of 2 mm wide and 20 μm thick amorphous alloy thin ribbons respectively constructed as shown in Table 4 were prepared by a single-roll method. The respective ribbon was cut into the length of 7 cm. Then the ribbon was heat-treated in the same manner as in Example 3. The sensitivity ratio in the case where the sensitivity of the amorphous ribbon of the same form (as defined in Example 1) was considered to be 1 was shown in Table 4. It is apparent from Table 4 that all of the samples according to the present invention have good sensitivity.

As described above in detail, the anti-theft sensor marker according to the present invention is excellent in sensitivity and suffer little deterioration of sensitivity due to bending stress. Further, the marker has an economical merit, because the marker can be formed of an alloy which mainly contains Fe. Consequently, the industrial effect according to the invention is very large.

TABLE 1

| | Material | sensitivity ratio |
|---|---|---|
| this invention | $Fe_{73.5}Cu_1Nb_3Si_{13.5}B_9$ | 4.5 |
| prior art | Amorphous ($CO_{70.5}Fe_{0.5}Mn_{6.5}Si_{13.5}B_9$ | 1 |
| | Supermalloy | 0.9 |

TABLE 2

| Components (at %) | heat treatment | Bs (T) | Br/Bs (%) | Hc (A/m) | μm | sensitivity ratio |
|---|---|---|---|---|---|---|
| $Fe_{74}Cu_{0.5}Si_{13.5}B_9Nb_3$ | H | 1.24 | 84 | 1.12 | 160,000 | 3.9 |
| $Fe_{74}Cu_{1.5}Si_{13.5}B_9Nb_2$ | H | 1.26 | 89 | 0.96 | 195,000 | 4.8 |
| $Fe_{79}Cu_{1.0}Si_8B_9Nb_3$ | H | 1.46 | 93 | 4.64 | 220,000 | 5.7 |
| $Fe_{74.5}Cu_{1.0}Si_{13.5}B_6Nb_5$ | H | 1.16 | 85 | 1.68 | 158,000 | 3.3 |
| $Fe_{77}CulSi_{10}B_9Nb_3$ | H | 1.43 | 86 | 1.92 | 178,000 | 3.4 |
| $Fe_{73.5}Cu_1Si_{17.5}B_5Ta_3$ | H | 1.05 | 94 | 1.28 | 165,000 | 4.0 |
| $Fe_{71}Cu_{1.5}Si_{13.5}B_9Mo_5$ | H | 1.12 | 87 | 0.96 | 148,000 | 3.2 |
| $Fe_{74}Cu_1Si_{14}B_8W_3$ | H | 1.21 | 73 | 1.92 | 111,000 | 2.8 |
| $Fe_{73}Cu_2Si_{13.5}B_{8.5}Hf_3$ | H | 1.16 | 65 | 2.16 | 103,000 | 2.0 |
| $Fe_{74.5}Cu_{1.0}Si_{13.5}B_9Ta_2$ | HF | 1.28 | 30 | 1.52 | 93,000 | 1.9 |
| $Fe_{72}Cu_1Si_{14}B_8Zr_5$ | HF | 1.17 | 24 | 2.32 | 86,000 | 1.5 |
| $Fe_{71.5}Cu_1Si_{13.5}B_9Ti_5$ | HF | 1.13 | 25 | 2.96 | 90,000 | 2.3 |
| $Fe_{73}Cu_{1.5}Si_{13.5}B_9Ta_3$ | HF | 1.14 | 22 | 1.44 | 80,000 | 2.1 |
| $Fe_{71}Cu_1Si_{13}B_{10}W_5$ | HF | 1.00 | 23 | 1.92 | 65,000 | 1.5 |
| $Co_{69.7}Fe_{0.4}Mn_{5.9}Si_{15}B_9$ | — | 0.78 | 56 | 1.20 | 55,000 | 1 |
| $Fe_{69.75}Ni_{7.75}Si_{13.5}B_9$ | — | 1.42 | 27 | 5.44 | 23,000 | 0.3 |
| Supermalloy | — | 0.51 | 19 | 14.4 | 81,000 | 0.9 |

TABLE 3

| Components (at %) | Bs (kG) | Hc (Oe) | λs ($\times 10^{-6}$) | sensitivity ratio | sensitivity ratio after taken up |
|---|---|---|---|---|---|
| $(Fe_{0.959}Ni_{0.041})_{73.5}Cu_1Si_{13.5}B_9Nb_3$ | 12.3 | 0.018 | +4.6 | 3.7 | 2.9 |
| $(Fe_{0.93}Ni_{0.07})_{73.5}Cu_1Si_{13.5}B_9Nb_3$ | 12.1 | 0.023 | +4.8 | 2.6 | 2.1 |
| $(Fe_{0.9}Ni_{0.1})_{73.5}Cu_1Si_{13.5}B_9Nb_3$ | 11.8 | 0.020 | +5.2 | 2.5 | 1.7 |
| $(Fe_{0.986}Co_{0.014})_{73.5}Cu_1Si_{13.5}B_9Nb_3$ | 12.6 | 0.011 | +4.0 | 3.8 | 3.0 |
| $(Fe_{0.959}Co_{0.041})_{73.5}CulSi_{13.5}B_9Nb_3$ | 13.0 | 0.015 | +4.0 | 2.9 | 2.2 |
| $(Fe_{0.9}Co_{0.1})_{73.5}Cu_1Si_{13.5}B_9Nb_3$ | 13.2 | 0.020 | +5.5 | 3.1 | 1.8 |
| $Fe_{71.5}Cu_1Si_{15.5}B_7Nb5$ | 10.7 | 0.012 | +2.8 | 3.2 | 2.9 |
| $Fe_{71.5}Cu_1Si_{17.5}B_5Nb5$ | 10.2 | 0.010 | +2.0 | 2.6 | 2.4 |
| $Fe_{71.5}Cu_1Si_{20.5}B_5Nb3$ | 10.8 | 0.027 | ~0 | 4.5 | 4.3 |
| $Fe_{75.5}Cu_1Si_{13.5}B_7Nb3$ | 13.3 | 0.011 | +1.5 | 4.1 | 3.6 |
| $Fe_{72}Cu_1Si_{19}B_5Nb3$ | 11.4 | 0.021 | +0.6 | 3.5 | 3.2 |
| $Fe_{73.5}Cu_1Si_{18.5}B_4Nb3$ | 11.7 | 0.015 | −1.6 | 4.8 | 4.3 |

TABLE 4

| Components of alloy (atomic %) | sensitivity ratio |
|---|---|
| $Fe_{71}Cu_1Si_{15}B_9Nb_3Ti_1$ | 3.8 |
| $Fe_{69}Cu_1Si_{15}B_9W_5V_1$ | 3.2 |
| $Fe_{69}Cu_1Si_{16}B_8Mo_5Mn_1$ | 4.1 |
| $Fe_{69}Cu_1Si_{17}B_7Nb_5Ru_1$ | 3.3 |
| $Fe_{71}Cu_1Si_{14}B_{10}Ta_3Rh_1$ | 2.9 |
| $Fe_{72}Cu_1Si_{14}B_9Zr_3Pd_1$ | 5.1 |
| $Fe_{72.5}Cu_{0.5}Si_{14}B_9Hf_3Ir_1$ | 3.4 |
| $Fe_{70}Cu_2Si_{16}B_8Nb_3Pt_1$ | 3.7 |
| $Fe_{70.5}Cu_{1.5}Si_{15}B_9Nb_5Au_1$ | 3.6 |
| $Fe_{71.5}Cu_{0.5}Si_{15}B_9Nb_3Zn_1$ | 4.3 |
| $Fe_{69.5}Cu_{1.5}Si_{15}B_9Nb_3Mo_1Sn_1$ | 4.4 |
| $Fe_{68.5}Cu_{2.5}Si_{15}B_9Nb_3Ta_1Re_1$ | 5.2 |
| $Fe_{70}Cu_1Si_{15}B_9Nb_3Zr_1Al_1$ | 3.7 |
| $Fe_{70}Cu_1Si_{15}B_{9Nb3}Hf_1Sc_1$ | 4.4 |
| $Fe_{70}Cu_1Si_{15}B_9Hf_3Zr_1Y_1$ | 3.6 |
| $Fe_{71}Cu_1Si_{15}B_9Nb_3La_1$ | 4.6 |
| $Fe_{67}Cu_1Si_{17}B_9Mo_3Ce_1$ | 4.1 |
| $Fe_{67}Cu_1Si_{17}B_9W_5Pr_1$ | 3.9 |
| $Fe_{67}Cu_1Si_{17}B_9Ta_5Nd_1$ | 4.2 |
| $Fe_{67}Cu_1Si_{17}B_9Zr_5Sm_1$ | 3.6 |
| $Fe_{67}Cu_1Si_{16}B_{10}Hf_5Eu_1$ | 2.6 |
| $Fe_{68}Cu_1Si_{18}B_9Nb_3Gd_1$ | 3.2 |
| $Fe_{68}Cu_1Si_{19}B_8Nb_3Tb_1$ | 1.9 |
| $Fe_{72}Cu_1Si_{14}B_9Nb_3Dy_1$ | 2.8 |
| $Fe_{72}Cu_1Si_{14}B_9Nb_3Ho_1$ | 5.0 |
| $Fe_{71}Cu_1Si_{14}B_9Nb_3Cr_1Ti_1$ | 3.2 |
| $(Fe_{0.95}Cu_{0.01})_{72}Cu_1Si_{14}B_9Nb_3Cr_1$ | 2.8 |
| $(Fe_{0.95}Cu_{0.05})_{72}Cu_1Si_{14}B_9Ta_3Ru_1$ | 4.5 |
| $(Fe_{0.9}Cu_{0.1})_{72}Cu_1Si_{14}B_9Ta_3Mn_1$ | 4.3 |
| $(Fe_{0.99}Ni_{0.01})_{72}Cu_1Si_{14}B_9Ta_3Ru_1$ | 4.2 |
| $(Fe_{0.95}Ni_{0.05})_{71}Cu_1Si_{14}B_9Ta_3Cr_1Ru_1$ | 3.6 |
| $(Fe_{0.90}Ni_{0.1})_{68}Cu_1Si_{15}B_9W_5Ti_1Ru_1$ | 3.3 |
| $(Fe_{0.95}Co_{0.03}Ni_{0.02})_{69.5}Cu_1Si_{13.5}B_9W_5Cr_1Rh_1$ | 2.7 |
| $(Fe_{0.98}Co_{0.01}Ni_{0.01})_{67}Cu_1Si_{15}B_9W_5Ru_3$ | 4.6 |
| $Fe_{73}Cu_1Si_{13}B_9Ni_3C_1$ | 3.6 |
| $Fe_{73}Cu_1Si_{13}B_9Nb_3Ge_1$ | 4.8 |
| $Fe_{73}Cu_1Si_{13}B_9Nb_3P_1$ | 3.7 |
| $Fe_{73}Cu_1Si_{13}B_9Nb_3Ga_1$ | 2.8 |

TABLE 4-continued

| Components of alloy (atomic %) | sensitivity ratio |
|---|---|
| $Fe_{73}Cu_1Si_{13}B_9Nb_3Sb_1$ | 2.6 |
| $Fe_{73}Cu_1Si_{13}B_9Nb_3As_1$ | 3.3 |
| $Fe_{71}Cu_1Si_{13}B_8Mo_5C_2$ | 5.2 |
| $Fe_{70}Cu_1Si_{14}B_6Mo_3Cr_1C_5$ | 4.3 |
| $(Fe_{0.95}Co_{0.05})_{70}Cu_1Si_{13}B_9Nb_5Al_1C_1$ | 4.5 |
| $(Fe_{0.98}Ni_{0.02})_{70}Cu_1Si_{13}B_9W_5V_1Ge_1$ | 2.6 |
| $Fe_{68.5}Cu_{1.5}Si_{13}B_9Nb_5Ru_1C_2$ | 2.8 |
| $Fe_{70}Cu_1Si_{14}B_8Ta_3Ru_2C_1$ | 3.3 |
| $Fe_{68}Cu_1Si_{15}B_9Nb_5Mn_1Be_1$ | 4.1 |
| $Fe_{69}Cu_2Si_{14}B_8Zr_5Rh_1In_1$ | 3.7 |
| $Fe_{71}Cu_2Si_{13}B_7Hf_5Au_1C_1$ | 3.6 |
| $Fe_{66}Cu_1Si_{16}B_{10}Mo_5Sc_1Ge_1$ | 5.0 |
| $Fe_{67.5}Cu_{0.5}Si_{14}B_{11}Nb_5Y_1P_1$ | 4.2 |
| $Fe_{67}Co_1Si_{13}B_{12}Nb_5La_1Ga_1$ | 4.6 |
| $(Fe_{0.95}Ni_{0.05})_{67}Cu_1Si_{13}B_9Nb_5Sm_1Sb_1$ | 2.9 |
| $(Fe_{0.92}Co_{0.08})_{70}Cu_1Si_{13}B_9Nb_5Zn_5As_1$ | 3.1 |
| $(Fe_{0.96}Ni_{0.02}Co_{0.02})_{70}Cu_1Si_{13}B_9Nb_5Sn_1In_1$ | 3.6 |
| $Fe_{69}Cu_1Si_{13}B_9Mo_5Re_1C_2$ | 4.1 |
| $Fe_{69}Cu_1Si_{13}B_9Mo_5Ce_1C_2$ | 2.8 |
| $Fe_{69}Cu_1Si_{13}B_9W_5Pr_1C_2$ | 3.7 |
| $Fe_{69}Cu_1Si_{13}B_9W_5Nb_1C_2$ | 2.9 |
| $Fe_{68}Cu/Si_{14}B_9Ta_5Gd_1C_2$ | 3.6 |
| $Fe_{69}Cu_1Si_{13}B_9Nb_5Tb_1C_2$ | 4.3 |
| $Fe_{70}Cu_1Si_{14}B_8Nb_5Dy_1Ge_1$ | 3.7 |
| $Fe_{72}Cu_1Si_{13}B_7Nb_5Pd_1Ge_1$ | 2.6 |
| $Fe_{70}Cu_1Si_{13}B_9Nb_5Ir_1P_1$ | 5.3 |
| $Fe_{70}Cu_1Si_{13}B_9Nb_5Os_1Ga_1$ | 2.9 |
| $Fe_{71}Cu_1Si_{14}B_9Ta_3Cr_1C_1$ | 4.5 |
| $Fe_{67}Cu_1Si_{15}B_6Zr_5V_1C_3$ | 4.2 |
| $Fe_{63}Cu_1Si_{16}B_5Hf_5Cr_2C_8$ | 3.7 |
| $Fe_{68}Cu_1Si_{14}B_9Mo_4Ru_3C_1$ | 2.9 |
| $Fe_{70}Cu_1Si_{14}B_4Mo_3Ti_1Ru_1C_1$ | 2.8 |
| $Fe_{67}Cu_1Si_{14}B_9Nb_6Rh_2C_2$ | 3.3 |

What is claimed is:

1. An anti-theft sensor marker mainly composed of an alloy and employed in an anti-theft system in which the unlawful taking of a commodity marked by said marker is determined by detecting a magnetic field of a specific frequency with respect to an incident magnetic field intensity applied to a detection region through said alloy of said marker when said marker is disposed within said detection region, said alloy having the constitutional formula $$(Fe_{1-a}M_a)_{100-x-y-z-\alpha-\beta-\gamma}\,Cu_xSi_yB_zM'_\alpha M''_\beta X_\gamma$$
(atomic %)

wherein, M is at least one member selected from the group consisting of Co and Ni; M' is at least one member selected from the group consisting of Nb, W, Ta, Zr, Hf, Ti and Mo; M'' is at least one member selected from the group consisting of V, Cr, Mn, Al, platinum metals, Sc, Y, rare-earth metals, Au, Zn, Sn and Re; X is at least one member selected from the group consisting of C, Ge, P, Ga, Sb, In, Be and As; and a, x, y, z, $\alpha$, $\beta$ and $\gamma$ satisfy the relations: $0 \leqq a \leqq 0.3$, $0.1 \leqq x \leqq 3$, $6 \leqq y \leqq 25$, $3 \leqq z \leqq 15$, $14 \leqq y+z \leqq 30$, $1 \leqq \alpha \leqq 10$, $0 \leqq \beta \leqq 10$, $9 \leqq \gamma \leqq 10$, and wherein at least 50% of the structure of the alloy ribbon is composed of fine bccFe solid-solution crystalline grains in which the mean grain diameter, measured as a maximum grain diameter, is not larger than 500 Å.

2. The anti-theft sensor marker according to claim 1, wherein at least part of the surface of said alloy is provided with a coating layer thereon.

3. The anti-theft sensor marker according to claim 2, wherein the coating layer is a magnetic alloy having a semi-hard magnetic characteristic.

4. The anti-theft sensor marker according to claim 2, wherein the coating layer is one of Cu and Ni.

5. The anti-theft sensor marker according to claim 1, wherein the angular ratio of the direct-current B-H curve of said alloy is not less than 60%; and wherein the maximum magnetic permeability thereof is not less than 50,000.

6. The anti-theft sensor marker according to claim 1, further comprising first and second support members, said alloy ribbon being sandwiched between said members.

7. The anti-theft sensor marker according to claim 6, wherein said first support member consists of paper, and wherein said second support member consists of polypropylene.

8. The anti-theft sensor marker according to claim 1, wherein said crystalline grains are uniformly distributed.

9. The anti-theft sensor marker according to claim 1, wherein the mean grain diameter of said crystalline grains ranges between 20 and 200 Å.

10. The anti-theft sensor marker according to claim 1, wherein the alloy is in the form of a line.

11. The anti-theft sensor marker according to claim 1, wherein the alloy is in the form of a film.

12. The anti-theft sensor marker according to claim 1, wherein the saturation magnetostriction $\lambda s$ of said alloy is not larger than $+5\times10^{-6}$.

13. The anti-theft sensor marker according to claim 12, wherein the saturation magnetostriction $\lambda s$ of said alloy ribbon ranges between $-5\times10^{-6}$ and $+5\times10^{-6}$.

* * * * *